US008858113B1

(12) United States Patent
Bettendorf et al.

(10) Patent No.: US 8,858,113 B1
(45) Date of Patent: Oct. 14, 2014

(54) TIRE DEFLATION DEVICE FOR PUNCTURING ONE OR MORE TIRES OF A FLEEING VEHICLE

(71) Applicants: Leonard Jon Bettendorf, Gilbert, AZ (US); Kamal Mahajan, Greenlawn, NY (US)

(72) Inventors: Leonard Jon Bettendorf, Gilbert, AZ (US); Kamal Mahajan, Greenlawn, NY (US)

( * ) Notice: Subject to any disclaimer, the term of this patent is extended or adjusted under 35 U.S.C. 154(b) by 0 days.

(21) Appl. No.: 14/162,667

(22) Filed: Jan. 23, 2014

(51) Int. Cl.
*E01F 13/12* (2006.01)

(52) U.S. Cl.
CPC ..... *E01F 13/12* (2013.01)
USPC ..... 404/6

(58) Field of Classification Search
USPC ..... 404/6
IPC ..... E01F 13/12
See application file for complete search history.

(56) References Cited

U.S. PATENT DOCUMENTS

| | | | | | |
|---|---|---|---|---|---|
| 1,790,602 | A * | 1/1931 | Siefker | ..... | 116/67 R |
| 2,346,713 | A | 10/1942 | Walker | | |
| 5,330,285 | A | 7/1994 | Greves et al. | | |
| 5,452,962 | A | 9/1995 | Greves | | |
| 5,507,588 | A * | 4/1996 | Marts et al. | ..... | 404/6 |
| 5,611,408 | A | 3/1997 | Abukhader | | |
| 5,775,832 | A * | 7/1998 | Kilgrow et al. | ..... | 404/6 |
| 5,820,293 | A * | 10/1998 | Groen et al. | ..... | 404/6 |
| 5,839,849 | A | 11/1998 | Pacholok et al. | | |
| 5,921,704 | A * | 7/1999 | Pacholok et al. | ..... | 404/6 |
| 6,155,745 | A | 12/2000 | Groen et al. | | |
| 6,220,781 | B1 * | 4/2001 | Miller | ..... | 404/6 |
| 6,474,903 | B1 * | 11/2002 | Marts et al. | ..... | 404/6 |
| 6,623,205 | B1 * | 9/2003 | Ramirez | ..... | 404/6 |
| 7,025,526 | B2 * | 4/2006 | Blair | ..... | 404/6 |
| 7,210,875 | B1 | 5/2007 | Christle et al. | | |
| 7,573,379 | B2 | 8/2009 | Moormeier et al. | | |
| 8,202,019 | B2 * | 6/2012 | Lyddon et al. | ..... | 404/6 |
| 8,231,303 | B1 | 7/2012 | Bowen et al. | | |
| 2010/0008720 | A1 * | 1/2010 | Dhondy | ..... | 404/6 |
| 2014/0199118 | A1 * | 7/2014 | Wersching et al. | ..... | 404/6 |

* cited by examiner

*Primary Examiner* — Gary Hartmann
(74) *Attorney, Agent, or Firm* — Morgan Law Offices, PLC

(57) ABSTRACT

A tire deflation device includes a support rod disposed longitudinally within a housing, a plurality of T-shaped positioners spaced along the length of the support rod, a pair of spikes attached to each of the T-shaped positioners, each spike of the pair arranged in an opposite direction to the other, and a plurality of filler portions disposed between each of the pair of spikes. The housing includes a main housing portion, a first end portion and a second end portion. The main housing portion has three lateral sides. The positioners position the pairs of the spikes such that for every three pairs of the spikes, the first is arranged substantially parallel to the first lateral side, the second is arranged substantially parallel to the second lateral side, and the third is arranged substantially parallel to the third lateral side, wherein the pairs of spikes are spaced apart.

17 Claims, 9 Drawing Sheets

TIRE DEFLATION DEVICE FOR PUNCTURING ONE OR MORE TIRES OF A FLEEING VEHICLE

BACKGROUND OF THE INVENTION

1. Field of the Invention

The present invention relates to a tire deflation device useable by law enforcement to puncture one or more tires of a fleeing vehicle so as to stop or impede movement of the vehicle.

2. Description of the Related Art

Law enforcement officers need to stop motor vehicles in various situations. For example, a driver may refuse to "pull over" for a driving infraction. From the fact that the driver refuses to cooperate with the police for something relatively minor, it can be inferred that more than merely a traffic violation may be involved. Additionally, police officers need to stop vehicles that are fleeing the scene of crimes. As an example, a car may be spotted driving from an armed robbery. It is imperative that such a vehicle be intercepted. Currently, law enforcement uses several methods to stop motor vehicles, most commonly: (1) tactical vehicle interception, (2) road block, and (3) tire deflation.

Tactical vehicle interception involves approaching a fleeing vehicle and then physically intercepting it, such as by hitting the vehicle in a controlled manner so as to cause the driver of the fleeing vehicle to lose control of the vehicle. The most common method is called the precision immobilization technique (PIT). PIT involves positioning the front of the police vehicle alongside a rear portion of the target vehicle, then steering the police car into the rear side of the target vehicle so as to cause it to sharply turn in an opposite direction. However, PIT has several drawbacks, including the requirement that the police vehicle be placed in the correct position which may be difficult to achieve and there not be other vehicles or persons close by which could be struck. Furthermore, many police departments do not allow the PIT at speeds of more than 35 mph or against certain types of vehicles.

As for road blocks, effectiveness largely depends on the ability to close a road quickly enough while not allowing for an escape route. In many situations, the path of a fleeing vehicle will be difficult to predict, and the road block can be avoided by taking a different route. However, when implemented correctly, a road block is generally a safe and effective way to stop a motor vehicle.

Use of tire deflation devices involve placement of the tire deflation device in the path of the fleeing vehicle such that when one or more of the tires of the fleeing vehicle make contact with the device, they are punctured, impeding movement of or stopping the vehicle. Tire deflation devices include various spike strips such as the widely used "STOP STICK" brand of spike strips from Stop Tech Ltd. Drawbacks of conventional tire deflation devices include the requirement that the strips be manually placed at a location on the roadway ahead of the fleeing vehicle. Additionally, some spike strips do not perform well on certain types of ground surfaces.

Over the years, numerous other vehicle immobilization devices have been introduced. These include various devices to immobilize the vehicle's engine, for instance. While many of these technologies appear to be promising, they have not been widely embraced by law enforcement because of the expense, uncertainty as to effectiveness, and liability issues.

SUMMARY OF THE INVENTION

One aspect of the disclosure relates to a tire deflation device which includes a support rod disposed longitudinally within a housing, a plurality of T-shaped positioners spaced along the length of the support rod, a pair of spikes attached to each of the T-shaped positioners, each spike of the pair arranged in an opposite direction to the other, and a plurality of filler portions disposed between each of the pair of spikes. The housing includes a main housing portion, a first end portion and a second end portion. The main housing portion has three lateral sides. The positioners position the pairs of the spikes such that for every three pairs of the spikes, the first is arranged substantially parallel to the first lateral side, the second is arranged substantially parallel to the second lateral side, and the third is arranged substantially parallel to the third lateral side, wherein the pairs of spikes are spaced apart along the support rod. Accordingly, no matter the side of the tire deflation device impacted by the vehicle's tire, an ample number of spikes will be available to puncture the tire. The use of the support rod described herein provides increased structural support and integrity to the device. The tire deflation device can be used on a variety of ground surfaces, including uneven surfaces such as "dirt roads".

In an embodiment, the main housing portion comprises the shape of a triangular prism, wherein the first lateral side is at about a 60 degree angle from the second lateral side, and the third lateral side is at about a 60 degree angle from the second lateral side. In various embodiments, the first end portion is shaped as a pyramid, and friction enhancements are included on at least one of the lateral sides. In an embodiment, each pair of the spikes includes a hollow portion such that after the spikes penetrate the tire of a vehicle, the tips break off leaving the hollow portion stuck in the tire, allowing controlled deflation of the tire through the hollow portion.

In an embodiment, a plurality of light emitting diodes (LED) are arranged on an exterior surface of the tire deflation, which start to flash upon impact. The flashing LEDs make it easy to locate where the tire deflation device has landed.

These and other aspects, features, and advantages of the present invention will become apparent from the following detailed description of preferred embodiments, which is to be read in connection with the accompanying drawings.

DETAILED DESCRIPTION OF THE INVENTION

Figure 1:
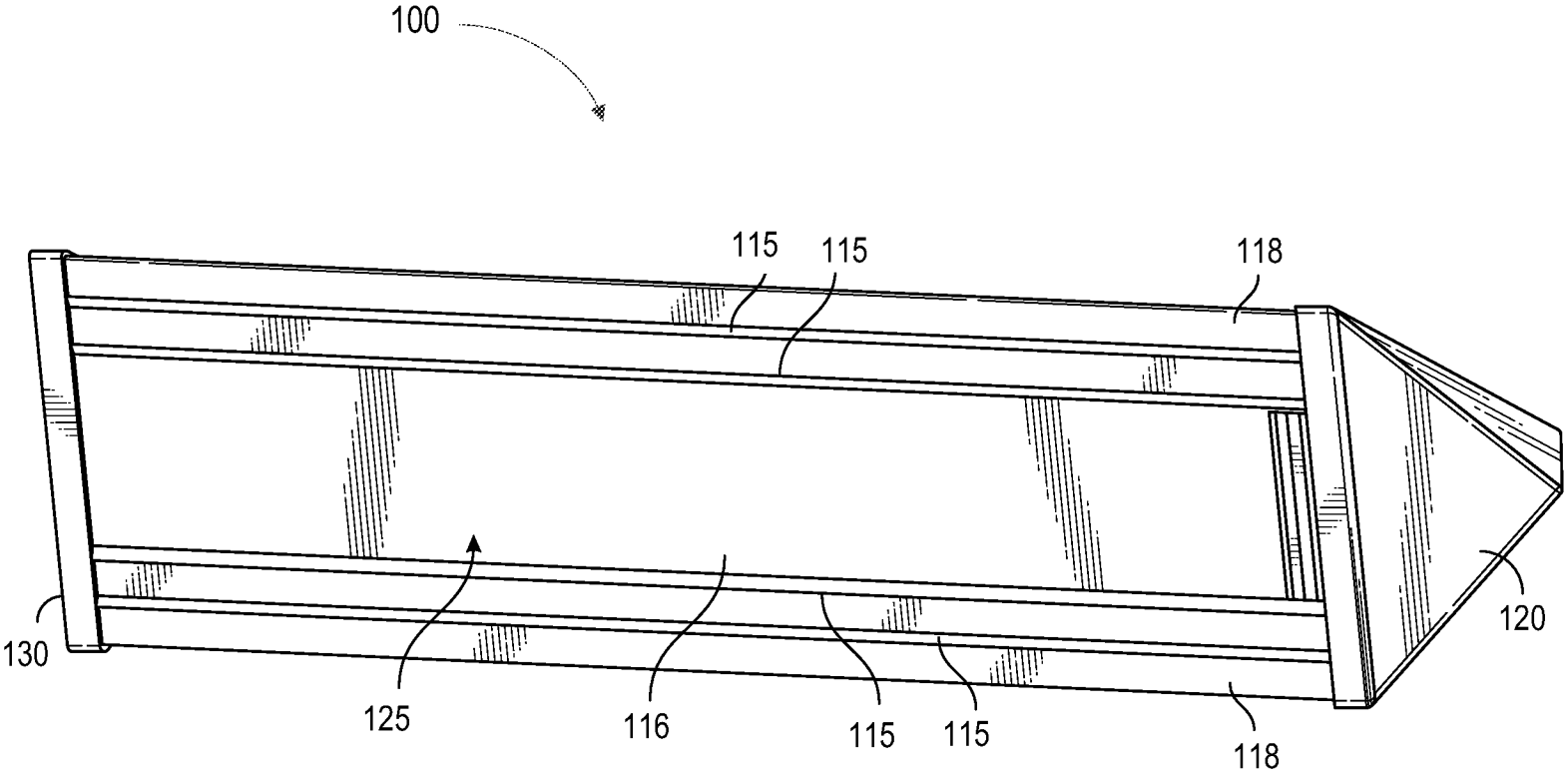
FIG. 1 illustrates a perspective view of an exemplary tire deflation device, according to an embodiment of the present invention.

Referring to FIG. 1, a perspective view of an exemplary tire deflation device 100, according to an embodiment of the present invention, is shown. As will be described in greater detail, the tire deflation device 100 includes a plurality of spikes disposed in an interior portion thereof, and when a vehicle drives over the tire deflation device 100, one or more tires of the vehicle are punctured by the spikes. Typically, tire deflation devices are inserted into a cloth sleeve (not shown), and the cloth sleeve along with the tire deflation devices therein is manually placed on a roadway ahead of the target vehicle. While the tire deflation device 100 described herein can be deployed in this manner, it can also be used with a tire deflation device ejection system. A tire deflation device ejection system which allows tire deflation devices to be launched from a police vehicle, and is suitable for deploying one or more of the tire deflation devices 100, is disclosed in U.S. Pat. No. 8,534,271 to Bettendorf et al., issued Sep. 17, 2013, and entitled "Microprocessor Based Vehicle Ejection Device Used to Deflate Tires," which is incorporated herein by reference in its entirety.

As illustrated, the tire deflation device 100 includes a main housing portion 125, a first end portion 120 and a second end portion 130, which attach to respective left and right ends of the main housing portion 125.

Figure 2:
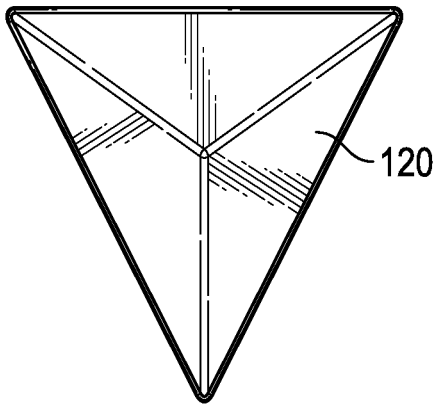
FIG. 2 illustrates a first end view of the tire deflation device.
Figure 3:
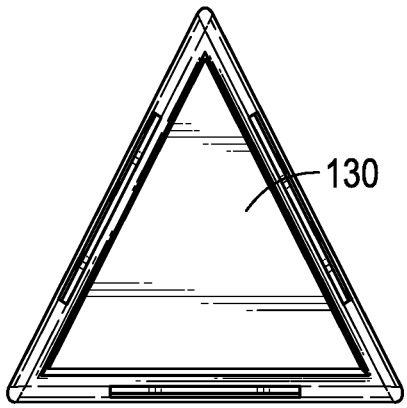
FIG. 3 illustrates a second end view of the tire deflation device.

FIGS. 2 and 3 show plan views of the first end portion 120 and the second end portion 130, respectively, according to an embodiment of the present invention. In the illustrated embodiment, the first end portion 120 is pyramid shaped and the bottom portion 130 is substantially flat. The pyramid shape increases the aerodynamics of the device and aids in ejection, and this design is most suitable when the device is to be used with a tire deflation device ejection system. Additionally, this design ensures that air pressure does not pass by or escape. In other embodiments, the first end portions 120, 130 can both be substantially flat, or have any other shape.

The main housing portion 125 has a triangular cross section comprising three lateral sides, each of the lateral sides including a panel 116 which can be a thin material such as an extruded plastic, e.g., polyvinyl chloride (PVC), or laminated paperboard, allowing the spikes to penetrate through the panel 116 when the tire of a vehicle impacts the tire deflation device 100, such as by driving over the device 100. Accordingly, the panels 116 are made of such a material that allows for this penetration to easily occur. Each of the three corners of the housing 125 further includes a corner piece 118 that secures a pair of adjacent panels 116. The corner pieces 118 can be secured to the panels 116 using any suitable tape, adhesive, or by fastening, such as by using a plurality of staples or sewn, etc. Additionally, the panels 116 can include a plurality of friction-reducing strips 115, which can be a plurality ridges for this purpose, useful in reducing friction inside the launching system. The first end portion 120 and the second end portion 130 can be made of molded plastic, for example.

Figure 4:
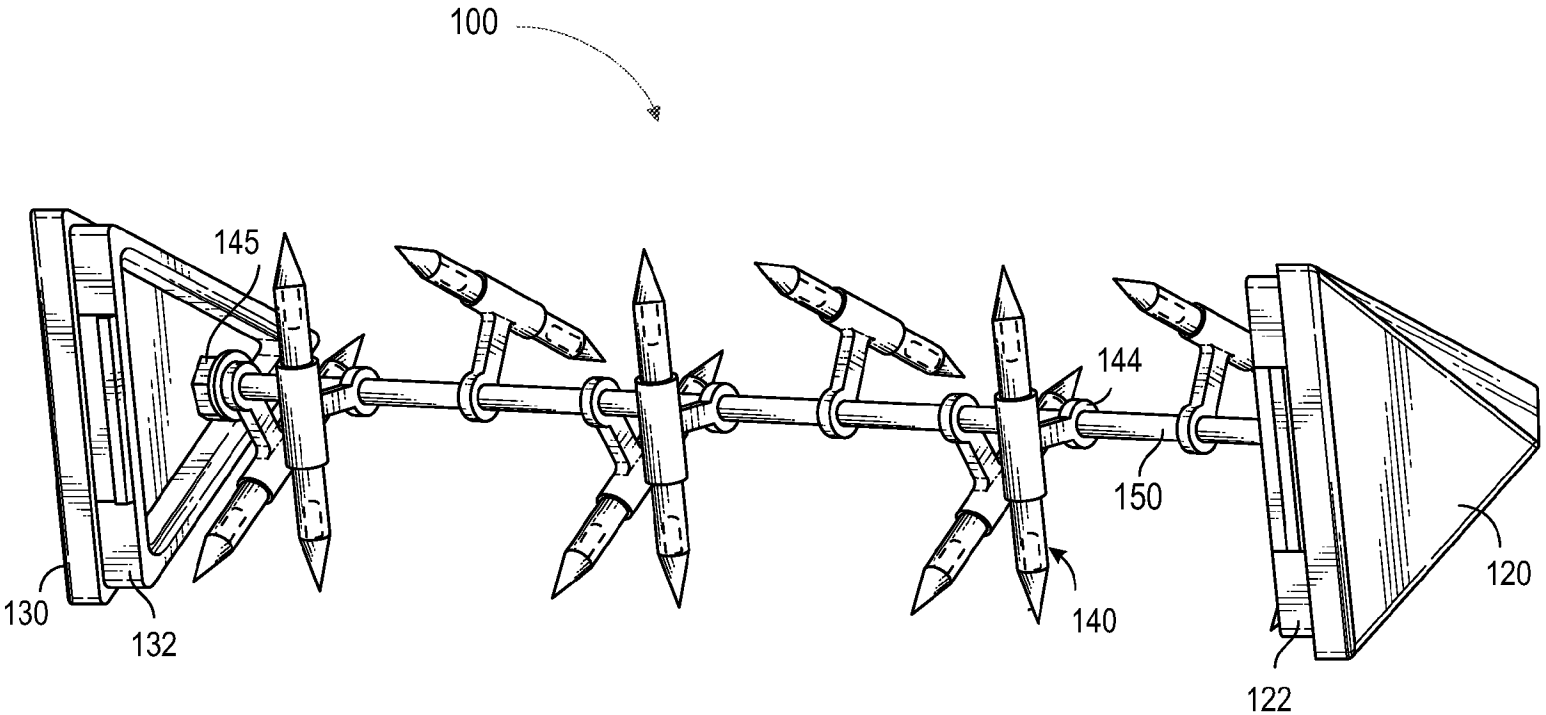
FIG. 4 illustrates an cutaway interior view of the tire deflation device of FIG. 1.
Figure 5:
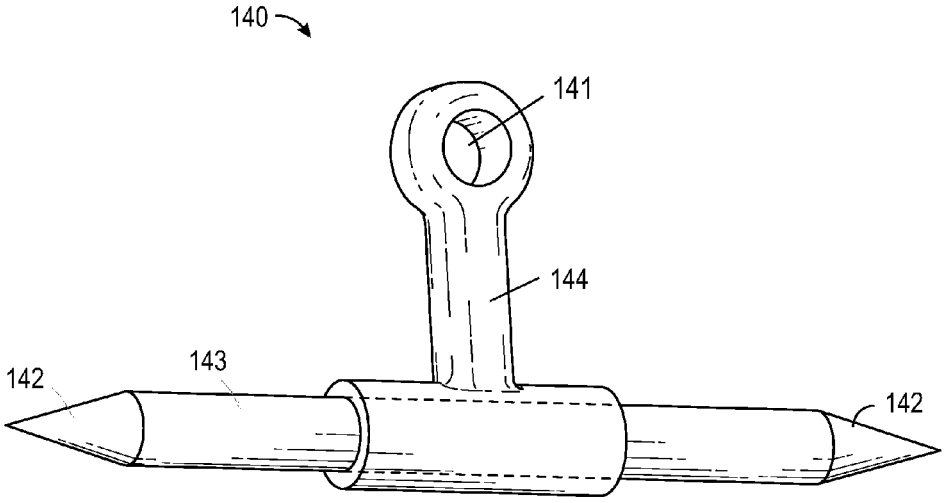
FIG. 5 illustrates a positioner holding a hollow tube having spikes on opposite ends thereof.

FIGS. 4 and 5 illustrate cutaway interior views of the tire deflation device 100, according to an embodiment of the present invention. As shown in FIG. 4, the first end portion 120 and the second end portion 130 can be friction fitted (or adhered) to grooves 122, 132, respectively.

Referring to FIG. 4, a support rod 150 is disposed longitudinally within the interior of the device 100. The support rod includes a plurality of T-shaped positioners 144 disposed along the length of the support rod 150. The positioners 144 position pairs of spikes 140 along the support rod 150 such that for every three pairs of the spikes 140, the first is arranged substantially parallel to a first lateral side, the second is arranged substantially parallel to a second lateral side, and the third is arranged substantially parallel to a third lateral side, wherein each of the pairs of spikes 140 is spaced apart (e.g., at about one-inch intervals).

As shown in FIG. 5, each pair of the spikes 140 includes a pair of spike tips 142 which are made of a hardened metal such as steel and sharp enough to penetrate tire rubber. The spike tips 142 can be coated with a stick-resistant material such as Teflon. The spike tips 142 can be made of hardened carbon steel and be about 10 mm in length with a sharp point disposed on opposite ends of a spike quill 143, which can be a hollow hardened cold rolled pin about 55 mm in length. The spike tips 142 are held in the spike quill 143 relatively loosely allowing them to fall off during impact. When one of the spike tips 142 enters a tire of a vehicle, the opposite spike tip 142 (on the other end of the spike quill 143) falls off from impact. As the tire turns, the remaining spike tip 142 then also falls off, leaving just the hollow spike quill 143 in the tire. Air from the tire escapes through the spike quill 143, creating a controlled deflation of the tire. As shown, the positioners 144 include a circular hole having an inner diameter about the same as the support rod 150, and can be friction fitted and/or adhered thereto. The positioners 144 can be made of a plastic material.

Referring again to FIG. 4, the support rod 150 can be attached to the first end portion 130 and the second end portion 120 by, for example, a fastener 145.

Figure 6:
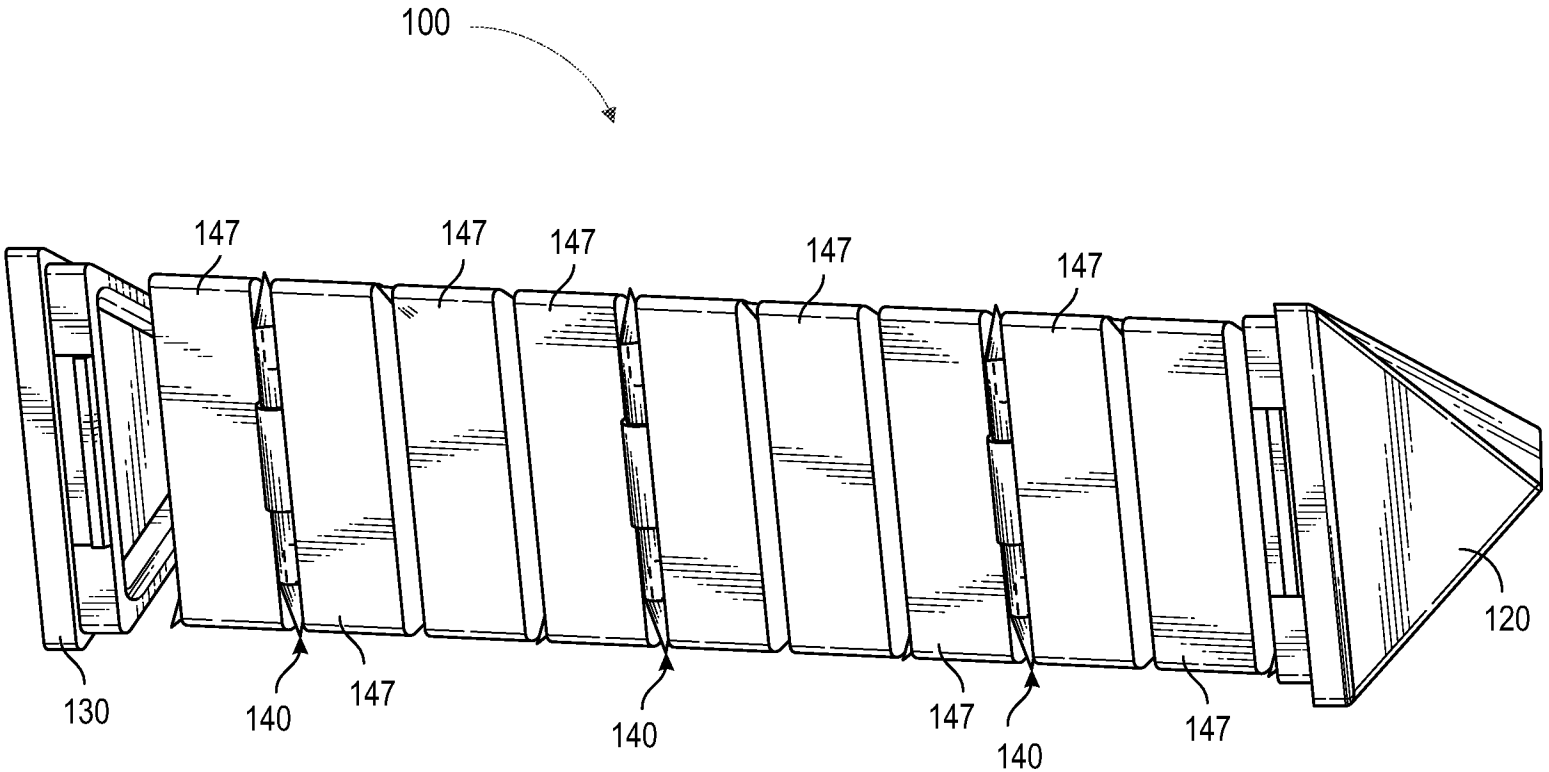
FIG. 6 illustrates another cutaway interior view of the tire deflation device of FIG. 1.

FIG. 6 shows that a plurality of filler portions 147 (which can be made of Styrofoam or a similar light and sturdy material) can be inserted in between each of the pairs of the spikes 140. Each of the filler portions 147 includes a hole in the Styrofoam to accommodate the support rod 150.

Referring again to FIG. 1, it can be seen that the housing (comprising the main housing portion 125, the first end 120 and the second end 130) encapsulates the support rod 150, the positioners 144 and the spikes 140).

While the tire deflation device 100 illustrated herein shows only nine pairs of spikes 140 held onto the support rod 150 by nine positioners 144, it is to be understood that this is not meant to be limiting, and the number of such elements chosen in practice can be different from shown. For example, in an embodiment, the device is about three feet in length, and includes about 27 spikes spaced at about one inch intervals.

Figure 7:
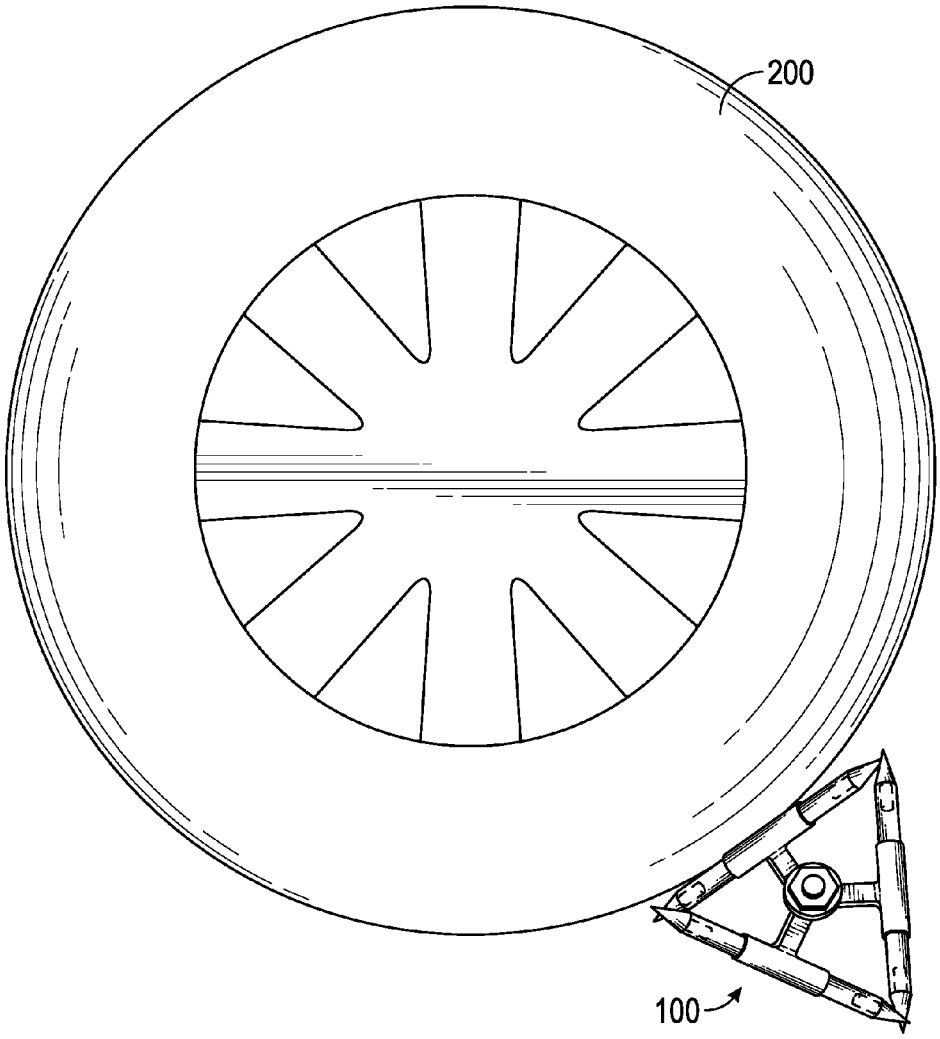
FIG. 7 illustrates the spikes of the tire deflation device positioned to puncture a tire.
Figure 8:
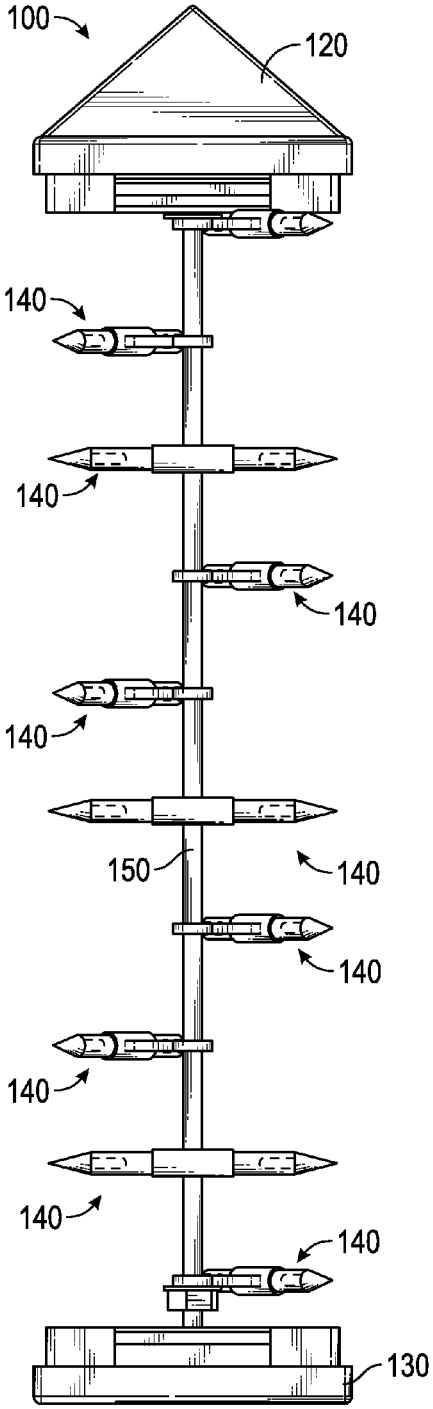
FIGS. 8 to 11 illustrate various views of the tire deflation device.
Figure 9:
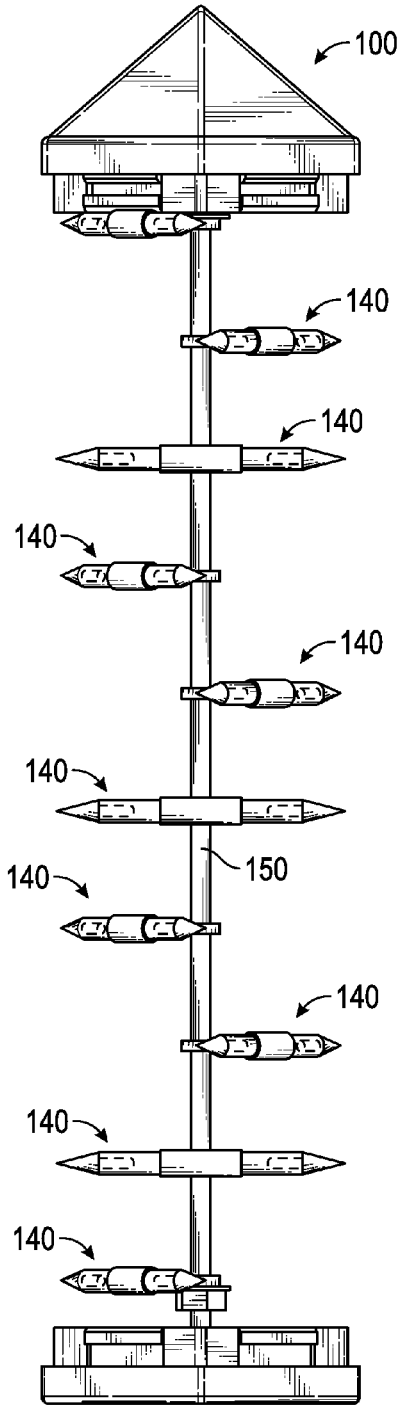
Figure 10:
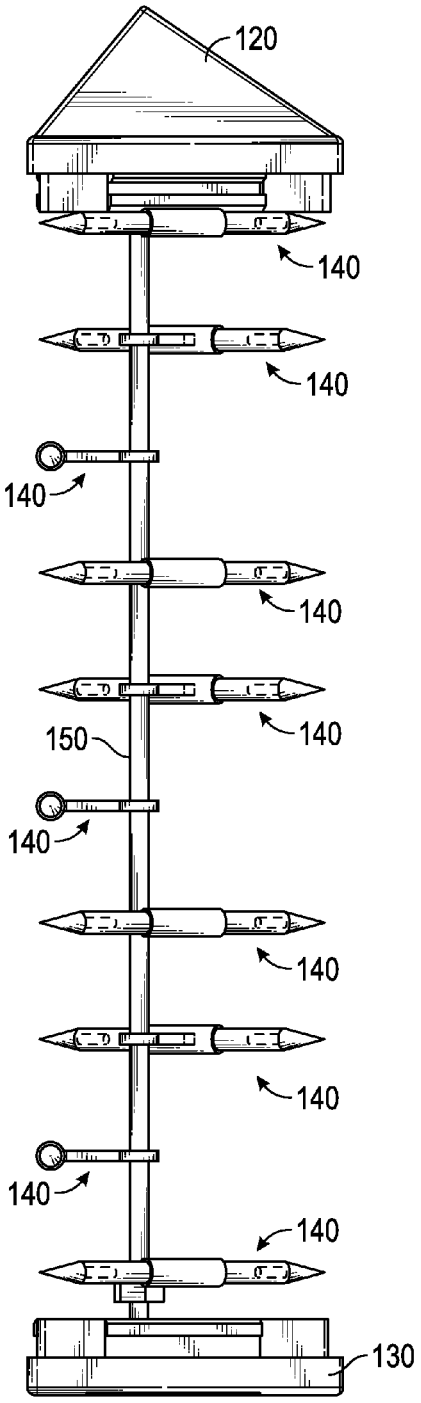
Figure 11:
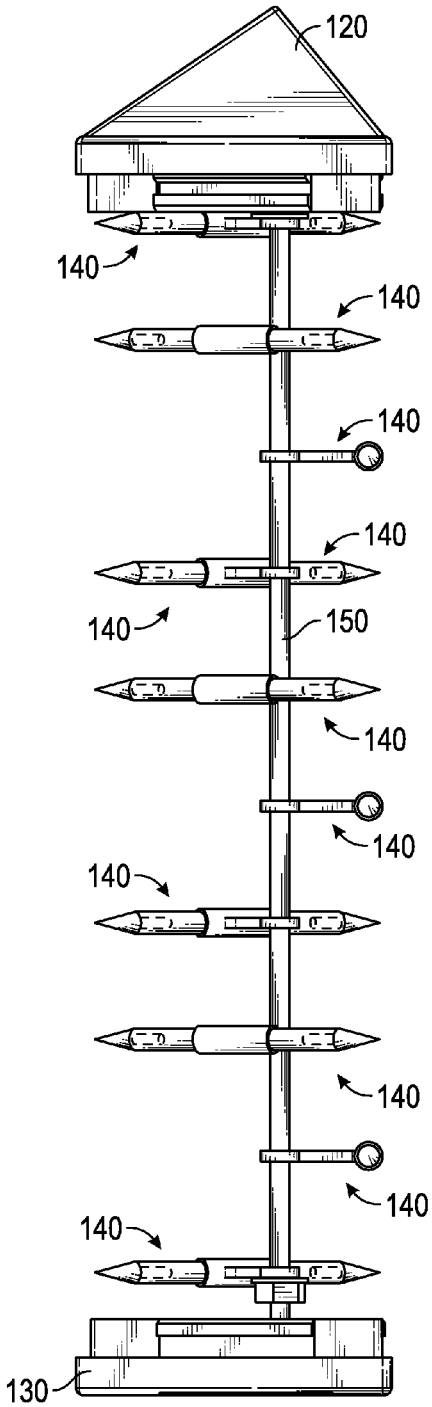

FIG. 7 illustrates tire deflation device 100 positioned to puncture a tire 200. As depicted, the housing is not shown to illustrate that the spikes will point to each of the sides of the tire deflation device 100 no matter which side is impacted by the tire 200. Further, as can be seen, the support rod 150 provides structural integrity to the device which allows the device to be used on various types of ground surfaces including semi-soft surfaces.

FIGS. 8 to 11 illustrate various views of the tire deflation device 100, according to the embodiment of the invention shown in FIG. 1.

Figure 12A:
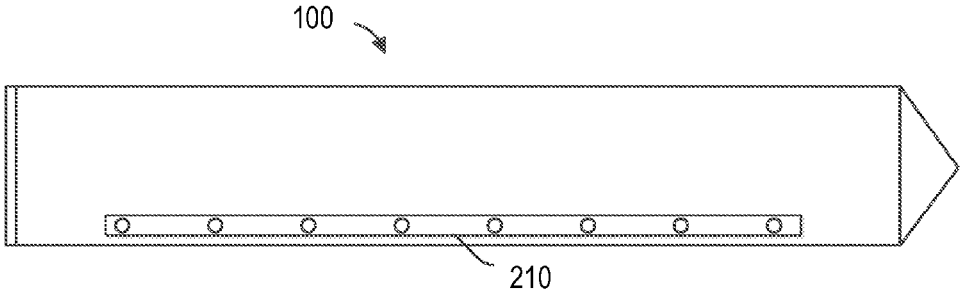
FIGS. 12A-12B illustrate usage of LED lights to locate where the tire deflation device has landed.
Figure 12B:
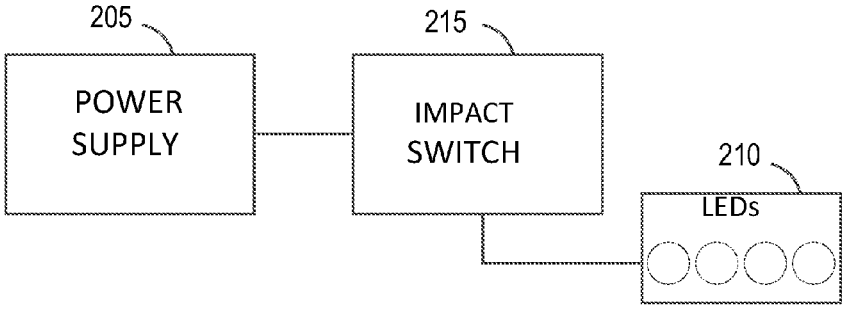

12A-12B illustrate usage of LED lights to locate where the tire deflation device 100 has landed. As shown in FIG. 12A, an LED strip 210 including a plurality of LEDs, which can be electrically connected in series, are attached to an exterior surface of the tire deflation device 100. It is to be understood that the LED strip 210 is not shown to scale. Further, it is to be understood that the LED strip 210 could be disposed on a different part of the device and need not be arranged in a linear fashion. As is known in the art, an LED strip can include a circuit that causes the individual LEDs to continually flash and a controller to allow the lights to wait a specified time (e.g., one minute) and then flash for a specified number of minutes. As shown in FIG. 12B, the LED strip 210 is powered by a power supply 205 which can include at least one battery of the proper voltage. Disposed between the power supply 205 and the LED strip 210 is an impact switch 215 which senses when the device has impacted a ground surface and then opens the electrical circuit. Alternatively, an acceleration switch can be used which senses that the device has been launched from a tire deflation device ejection system, or the tire deflation device ejection system itself can turn the switch on upon deployment of the tire deflation device without the need for a sensor. It is to be understood that various other electrical elements, such as one or more resistors to limit the amount of electrical current to the LEDs, can be included in the circuit.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A tire deflation device, comprising:

a housing including a main housing portion having at least three lateral sides, a first end portion and a second end portion;

a support rod disposed longitudinally within the housing;

a plurality of positioners spaced along the length of the support rod, the positioners each including a first portion and a second portion substantially perpendicular to the first portion;

a pair of spikes attached to each of the second portions, each of the spikes of the pair pointing in an opposite direction to the other; and a plurality of filler portions disposed between each of the pair of spikes.

2. The tire deflation device of claim 1, wherein the housing encapsulates the support rod, the positioners, the filler portions and the spikes.

3. The tire deflation device of claim 1, wherein the main housing portion has a first lateral side, a second lateral side and a third lateral side, and the positioners position the pairs of the spikes along the support rod such that for every three pairs of the spikes, the first is arranged substantially parallel to the first lateral side, the second is arranged substantially parallel to the second lateral side, and the third is arranged substantially parallel to the third lateral side, wherein each of the pairs of spikes is spaced apart.

4. The tire deflation device of claim 3, wherein the main housing portion comprises a triangular prism.

5. The tire deflation device of claim 4, wherein the first lateral side is at about a 60 degree angle from the second lateral side, and the third lateral side is at about a 60 degree angle from the second lateral side.

6. The tire deflation device of claim 1, wherein the top is shaped as a pyramid.

7. The tire deflation device of claim 1, wherein friction reducers are included on at least one of the lateral sides.

8. The tire deflation device of claim 1, wherein each of the pair of spikes of the pair of spikes includes a hollow tube.

9. The tire deflation device of claim 8, wherein each of the spikes of the pair of spikes includes a spike tip.

10. The tire deflation device of claim 9, wherein each spike tip of the pair of spikes is disposed on an opposite end of a hollow tube.

11. The tire deflation device of claim 1, wherein at least some of the spikes can penetrate through the housing and puncture a tire of a vehicle when the vehicle is driven over the device.

12. A tire deflation device, comprising:

a support rod disposed longitudinally within a housing;

a plurality of T-shaped positioners spaced along the length of the support rod;

a pair of spikes attached to each of the T-shaped positioners, each of the spikes of the pair arranged in an opposite sides of a hollow tube;

a plurality of filler portions disposed between each of the pair of spikes; and the housing, wherein the housing encapsulates the support rod, the positioners, the filler portions and the spikes;

wherein at least some of the spikes can penetrate through the housing and puncture a tire of a vehicle when the vehicle is driven over the device.

13. The tire deflation device of claim 12, wherein the housing includes a main housing portion, a first side portion and a second side portion, the main housing portion having three lateral sides comprising a first lateral side, a second lateral side, and a third lateral side.

14. The tire deflation device of claim 13, wherein the positioners position the pairs of the spikes such that for every three pairs of the spikes, the first is arranged substantially parallel to the first lateral side, the second is arranged substantially parallel to the second lateral side, and the third is arranged substantially parallel to the third lateral side, wherein each of the pairs of spikes so positioned is spaced apart.

15. The tire deflation device claim 12, wherein the positioners each include a first portion and a second portion, the first and second portions perpendicular, the second portion including the pair of spikes.

16. The tire deflation device of claim 12, wherein each of the spikes of the pair of spikes includes a hollow portion.

17. The tire deflation device of claim 12, further comprising a plurality of light emitting diodes (LED) which are activated upon impact.

* * * * *